US005529029A

United States Patent [19]

Rowe et al.

[11] Patent Number: 5,529,029

[45] Date of Patent: Jun. 25, 1996

[54] TRI-LOBED CAM ENGINE

[75] Inventors: John A. Rowe; Manfred E. Timm, both of Whitby, Canada

[73] Assignee: Tritec Power Systems Ltd., Ajax, Canada

[21] Appl. No.: 265,357

[22] Filed: Jun. 24, 1994

[51] Int. Cl.[6] ..... F02B 59/00

[52] U.S. Cl. ..... 123/54.3; 123/197.1; 60/525; 92/72

[58] Field of Search ..... 123/54.1, 54.2, 123/54.3, 54.7, 55.2, 55.3, 197.1, 46 R; 92/165 R, 72; 60/525

[56] References Cited

U.S. PATENT DOCUMENTS

| | | | |
|---|---|---|---|
| 793,270 | 6/1905 | Blomgren | 123/54.3 |
| 1,825,417 | 9/1931 | Peterson | 123/54.2 |
| 2,124,604 | 7/1938 | Bidwell | 123/55.3 |
| 4,727,794 | 3/1988 | Kmicikiewicz | 123/197.1 |
| 5,035,221 | 7/1991 | Martin | 92/72 |
| 5,281,104 | 1/1994 | Bublitz | 92/72 |
| 5,315,767 | 5/1994 | Schoell | 123/54.3 |

FOREIGN PATENT DOCUMENTS

| | | | |
|---|---|---|---|
| 2307132 | 11/1976 | France | 123/54.3 |

*Primary Examiner*—Andrew M. Dolinar
*Assistant Examiner*—M. Macy
*Attorney, Agent, or Firm*—Kenneth M. Garrett

[57] ABSTRACT

In an engine having free floating reciprocating pistons each with a cam follower which bears on a tri-lobed cam, each cam follower is supported by a guide bearing running in a track which serves to transmit to the track lateral reactive force components generated between the cam and the cam follower.

17 Claims, 8 Drawing Sheets

TRI-LOBED CAM ENGINE

FIELD OF INVENTION

This invention relates to reciprocating piston engines which include a tri-lobed cam for converting the reciprocating piston movement to rotary movement or vice versa depending upon whether the engine is used in a motor or compressor mode.

BACKGROUND OF INVENTION

Reciprocating piston tri-lobed cam engines are disclosed in the following patents:

| | |
|---|---|
| U.S. patents | 1,765,237 |
| | 1,792,062 |
| | 2,124,604 |
| | 4,697,552 |

In each of the foregoing patents a pair of diametrically opposed pistons are provided which are coupled together in push-pull relationship by an inextensible link. Each piston has a cam-follower, the link serving to maintain the cam-followers in contact with the cam at all positions of rotation thereof. The coupling together of the pistons in this manner necessitates the shaping of the tri-lobed cam such that the dimension between diametrically opposed portions is substantially constant. Generally speaking, such shaping includes a flattening of the lobes of the cam and the formation of a concavity between adjacent pairs of lobes. These engines have a relatively large angular interval over which they are not self-starting when operated as external combustion engines.

In U.S. Pat. No. 1,203,855 there is disclosed a tri-lobed cam engine wherein the pistons are not connected together, whereby they are freefloating. The cam of this engine is asymmetrically shaped, whereby the engine would be suited for operation in one direction only. Moreover, the interaction between the cam-followers and the cam would generate a severe reactive force which urges the piston into contact with the wall of the cylinder in which it reciprocates, promoting a rapid wear.

It is an object of this invention to provide improved tri-lobed cam engines.

It is another object of this invention to provide tri-lobed cam engines which utilize free-floating pistons wherein inter-reactive forces between the piston and cylinder wall are reduced.

It is still another object of this invention to provide tri-lobed cam engines which have a symmetry whereby they may be operated in either forward or reverse directions with no change in either power or torque.

It is yet another object of this invention to provide tri-lobed cam engines that have a simple modular construction whereby the number and size of the cylinders can be easily altered.

It is a further object of this invention to provide tri-lobed cam engines that may be self-starting when operated as external combustion motors.

SUMMARY OF THE INVENTION

In accordance with one aspect of the invention, an engine comprises a housing with a shaft and tri-lobed cam and four free-floating piston means disposed on the housing in equi-spaced relationship. Each piston means includes a cylinder and a free floating piston for reciprocal movement within the cylinder and a cam-follower associated with each piston. The cam-follower has associated therewith a guide bearing means and the housing has track means along which the guide bearing means is movable. The guide bearing means serves to reduce cylinder-piston wear by transmitting to the track means reactive forces generated in the cam-follower by the cam, which would otherwise urge the piston into contact with its cylinder.

Preferably, the guide bearing means includes a pair of guide bearings disposed on axially opposed sides of the cam follower, the axial direction of the engine being considered to be that of the engine shaft. Also preferably, the guide bearing means and the cam follower are rotatable and suitably have a collinear axis of rotation.

With the reduction of piston-cylinder interaction and with the rolling motion of the cam follower and associated guide bearing means, the engine is particularly adapted for use as a high torque, essentially oil free air motor for use in the food processing trades.

In accordance with the preferred embodiment, the four piston means are arranged to form two diametrically opposed pairs, the cylindrical axes of the pairs of cylinders intersecting at the axis of the engine shaft, so as to provide a symmetry and reversibility of direction of the engine.

Preferably, the cam means is in the form of an equilateral triangle, the sides of which are essentially rectilinear. The lobes of the cam means are relatively sharply rounded with a radius suitably of about 6 mm (0.25 in.), which engine, when operated as an external combustion motor, may be self-starting.

In further accordance with the preferred embodiment the housing is provided with eight openings symmetrically arranged therearound, and conveniently each opening has an associated track means. Four of the openings may be closed with the above described piston means, which may be referred to as the primary piston means, with the remaining four openings capped off. Such engine is easily modified to form an eight cylinder engine merely be removing the caps and replacing them with secondary piston means which are essentially identical to the primary piston means.

The foregoing objects and aspects of the invention, together with other objects, aspects and advantages thereof will be more apparent from a consideration of the following description of the preferred embodiment thereof taken in conjunction with the drawings annexed hereto.

DESCRIPTION OF THE PREFERRED EMBODIMENT

Figure 1:
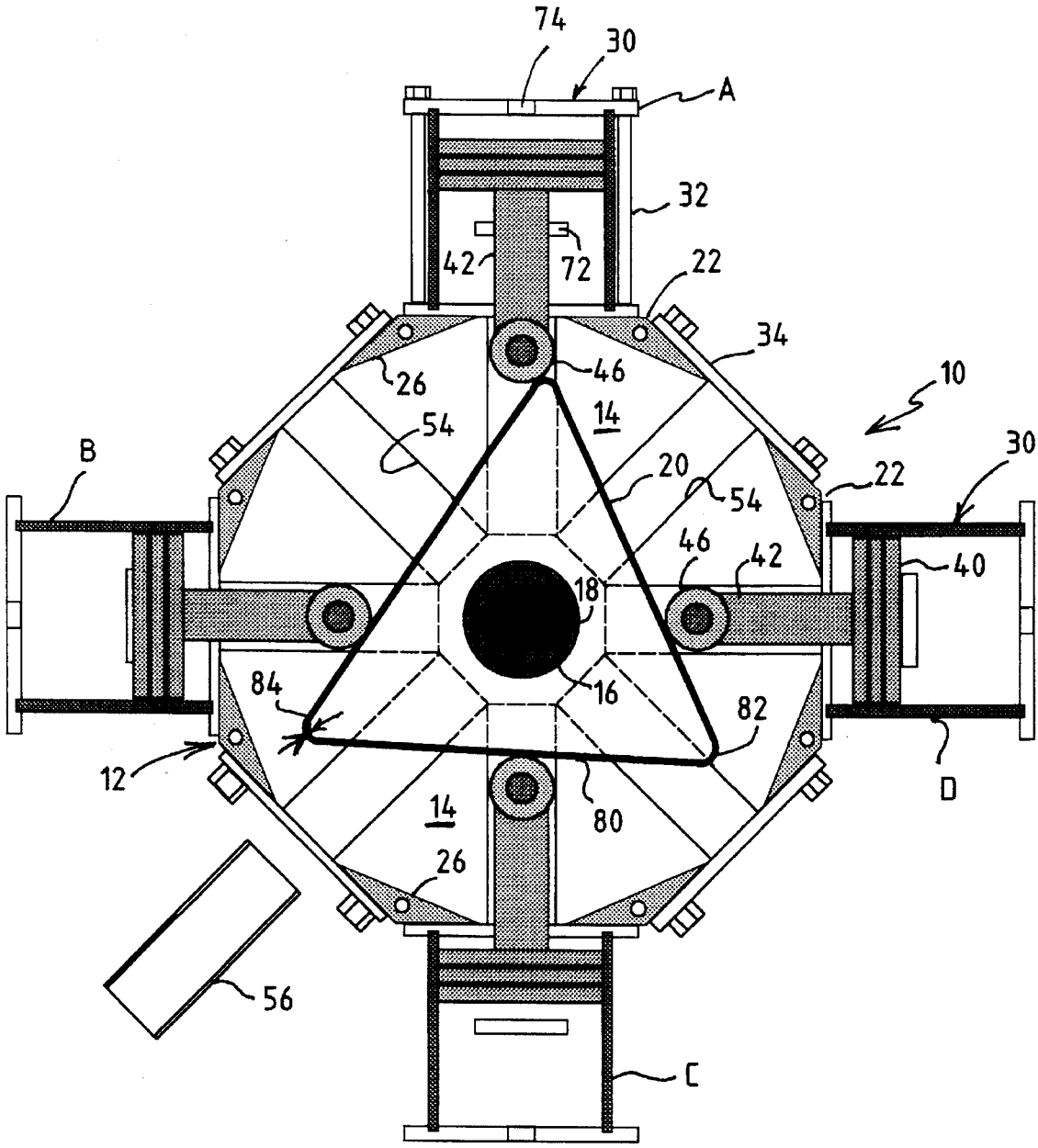
FIG. 1—is a schematic transverse mid-sectional view of a four cylinder engine in accordance with the invention.
Figure 2:
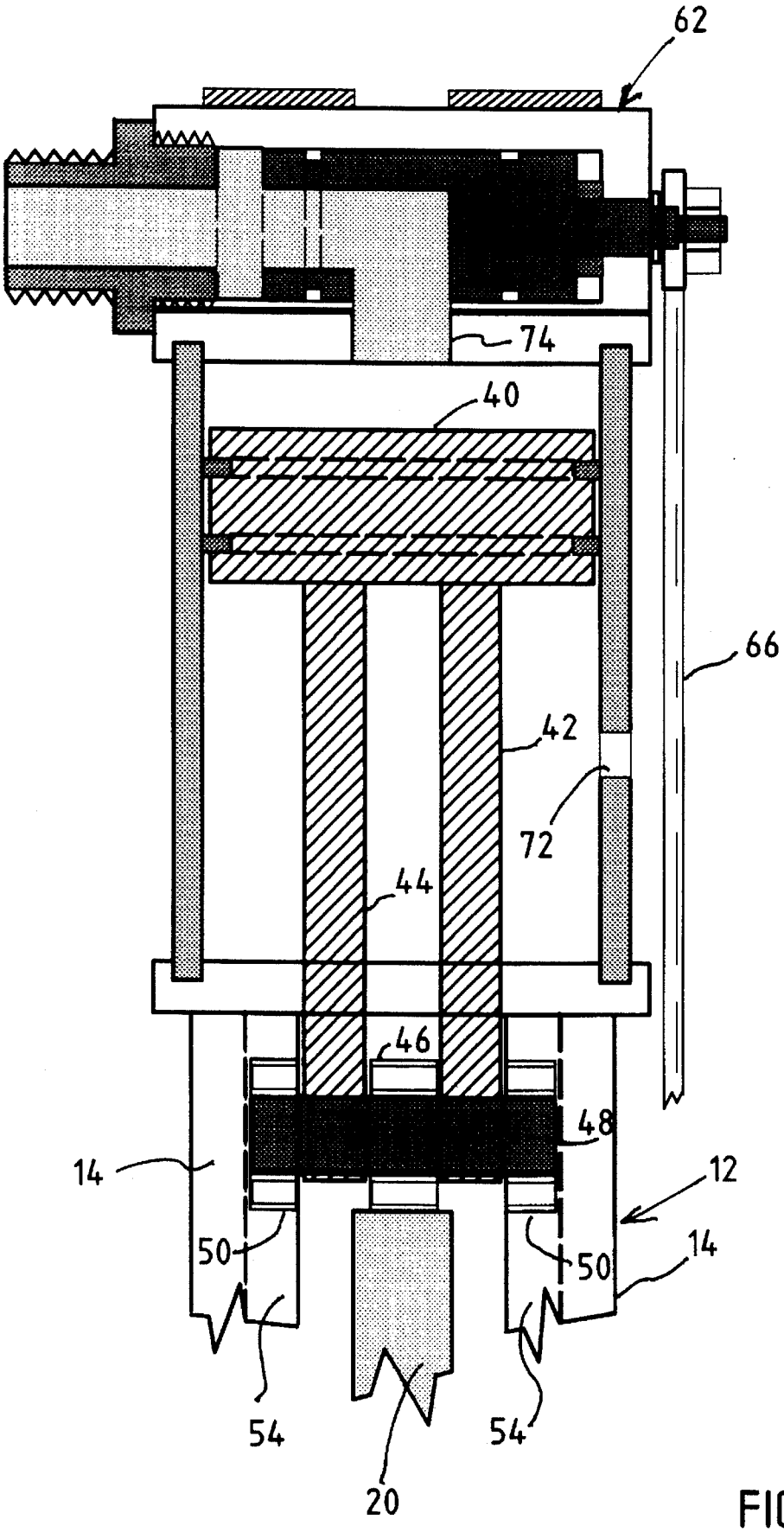
FIG. 2—is a schematic axial mid-sectional view through one cylinder of the engine of FIG. 1, with valve components shown in addition.
Figure 3:
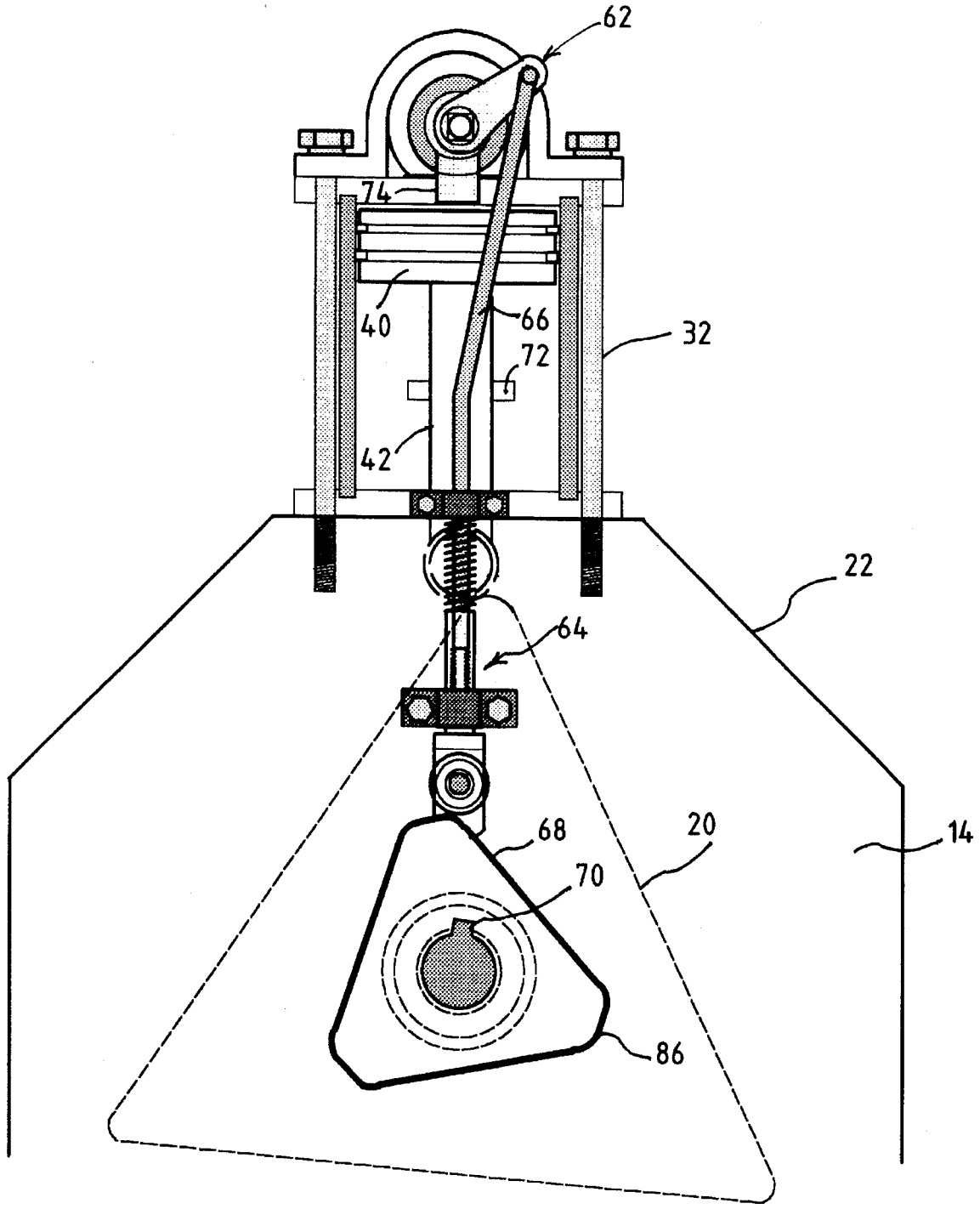
FIG. 3—is a schematic axial elevation showing further detail of a valve arrangement with hidden detail shown in dashed outline.
Figure 4:
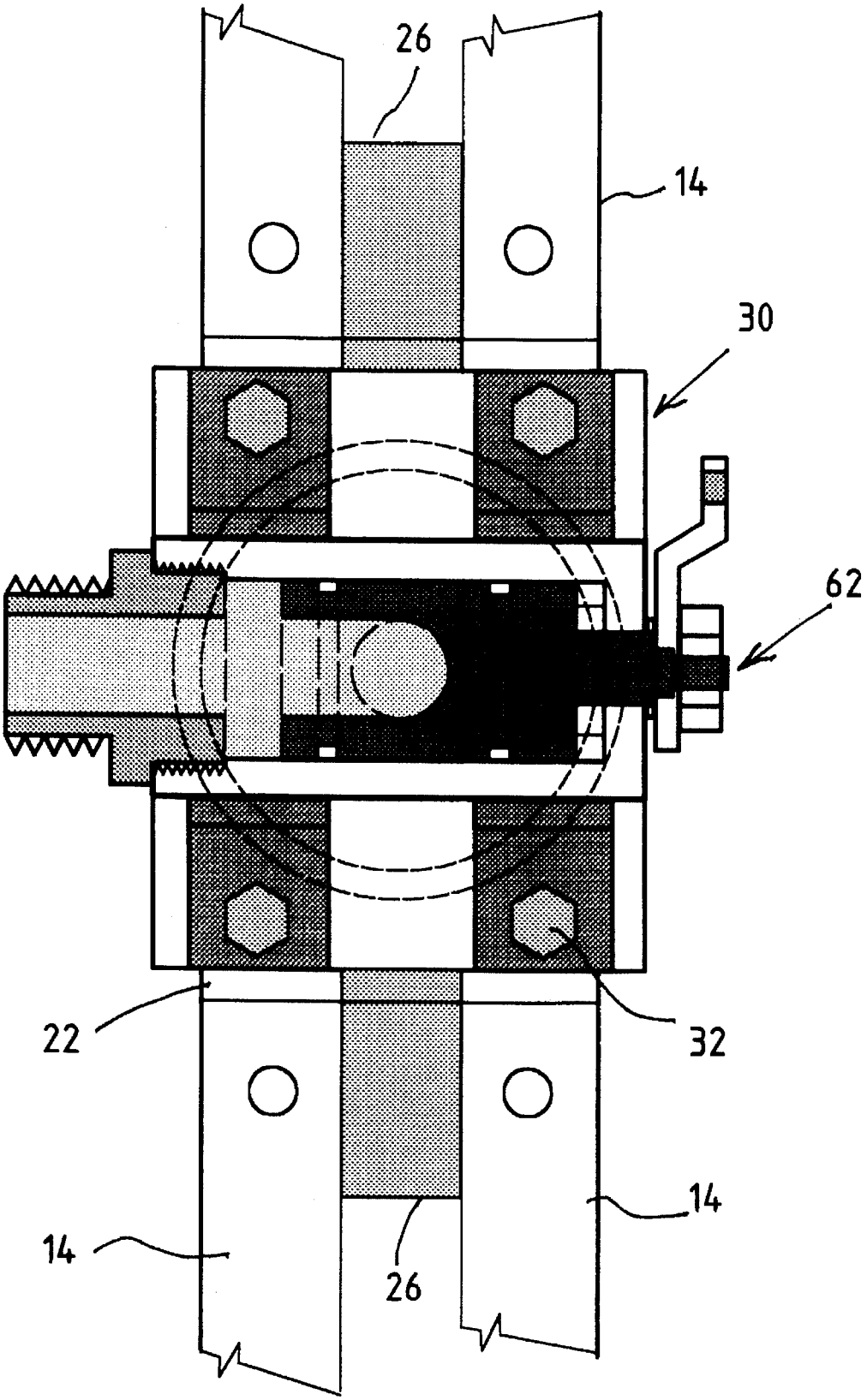
FIG. 4—is a plan view of the cylinder of FIG. 3.

Referring to the drawings in detail, an engine in accordance with the invention is identified generally therein by the numeral 10. Engine 10 comprises a housing 12 including a pair of opposed, spaced apart side plates with a shaft 16 mounted therefrom by bearings 18 for rotation. A cam 20 is mounted on shaft 16 for rotation therewith. Housing 12 includes eight facets forming mounts 22 disposed in equispaced relationship on a circle centered on the axis of rotation of shaft 16, with stiffening spacers 26 being disposed between the side plates 14 at each adjacent pair of mounts. A cylinder 50 is disposed on alternate ones of mounts 22 and secured thereto by bolts 32 which conveniently screw into side plates 14, those of mounts 22 not having a cylinder disposed thereon being generally closed off by a cap 34. Within each cylinder 30 is disposed a piston 40 from which is rigidly dependent a piston rod 42. Each piston rod 42 has a clevis opening 44 within which is mounted a cam follower 46 on a bearing pin 48 adjacent the distal end of the piston rod. Bearing pin 48 projects outwardly on opposed sides of clevis opening 44 to provide a mount for a pair of guide bearings 50 disposed on axially opposed sides of cam follower 46. Each mount 22 has associated therewith a pair of tracks 54 which are conveniently machined into side plates 14 and along which guide bearings 50 will roll as a piston 40 reciprocates in its cylinder 30. It will be understood that cylinders 30 and tracks 54 and bearing pins 48 are all centred on diameters passing through the axis of rotation of shaft 16.

Engine 10, where in the form of an external combustion motor includes a valve assembly 60 conveniently in the form of a rotating oscillating inlet valve 62 operated by a push rod assembly 64 disposed on the outside of housing 12 in association with each cylinder 30 and which includes a push rod 66 driven by a timing valve cam 68 disposed on engine shaft 16 and secured thereto by key 70. An exhaust port 72 is disposed in the wall of each cylinder 30 and an inlet port 74 in the head thereof.

Cam 20 is generally in the form of an isosceles triangle with rectilinear sides 80 and lobes 82 which are sharply rounded with a radius 84 of approximately 6 mm, which dimension may be relatively independent of the size of cam 20, at least over the range wherein sides 80 have a dimension in the range of about 5 cm to about 50 cm (2 in. to 20 in.). Timing cam 68 has a shape that is generally complementary to that of main cam 20, ie. is in the form of an isosceles triangle, although with the lobes 86 thereof substantially flattened as will be subsequently discussed.

Considering engine 10 operating as a motor from a source (not shown) of expandable gas, and differentiating the cylinders 30 for the purposes of the ensuing description with the letters A, B, C and D, and with the components in their relative positions as shown in FIG. 1, at start-up, assuming the engine valve cam 68 to be adjusted to provide a clockwise movement of shaft 16, the piston 40 of cylinder A will be marginally beyond its top dead center position. The inlet valve 62 to cylinder A will be marginally open, and those to cylinders B, C and D will be closed. Accordingly, the piston 40 of cylinder A will be urged downwardly by the expandable gas introduced into cylinder A, causing cam 20 and shaft 16 therewith to rotate in a clockwise direction. The valve 62 to cylinder A will suitably close when piston 40 of cylinder A has descended approximately one third of its stroke with lobes 86 being shaped accordingly. Concomitantly with the downward movement of the piston of cylinder A, the piston of cylinder B will be urged upwardly, trapping a volume of gas in the cylinder. Ultimately, the piston 40 of cylinder B will assume the position of the piston 40 of cylinder A illustrated in FIG. 1 and the expandable gas will be introduced into the cylinder B. At this time engine 10 will be operating dynamically, and a work output will be generated by the piston 40 of both cylinder A as this moves towards the bottom of its stroke, and the piston of cylinder B. The pistons of cylinders C and D will operate in analogous manner to pistons A and B and in general, when engine 10 is dynamically operational as a motor, two adjacent pistons will provide power on an expansion stroke and two adjacent pistons will be driven by cam 20.

In view of the relatively high torque output from engine 20, shaft 16 may often be coupled directly to a unit to be driven without any intermediate gear box. Where it is desired that the engine of FIG. 1 be operated in an anti-clockwise direction, it is merely required to flip timing cam 68 through 180°. It will be understood that other, somewhat more complex variations may be used for shifting timing cam 68 relative to shaft 16 for reversing the direction of rotation of the engine.

Considering now valve cam 68 to be adjusted to operate engine 10 as a motor turning in an anti-clockwise direction and considering the parts to be in the relative positions as seen in FIG. 1, at start-up the piston of cylinder A will be in a position marginally before top dead center and the inlet valves 62 to cylinders A, C and D will be closed. The inlet valve 62 to cylinder B will be open, urging the piston 40 thereof downwardly, thereby causing cam 20 to rotate in an anti-clockwise direction and shaft 16 therewith. When cam 20 is rotated to a position to urge the piston 40 of cylinder A to its top dead center position, the inlet valve 62 to cylinder A will open and the sequence of operations described above in relation to the engine when operated in a clockwise direction is repeated in reverse.

The rolling action of cam followers 46 and guide bearings 52 and the reduction of side forces on pistons 40 permits engine 10 to be operated under certain conditions without lubrication, or with lubrication provided only through the use of sealed bearings, which is highly advantageous under adverse conditions.

Figure 5:
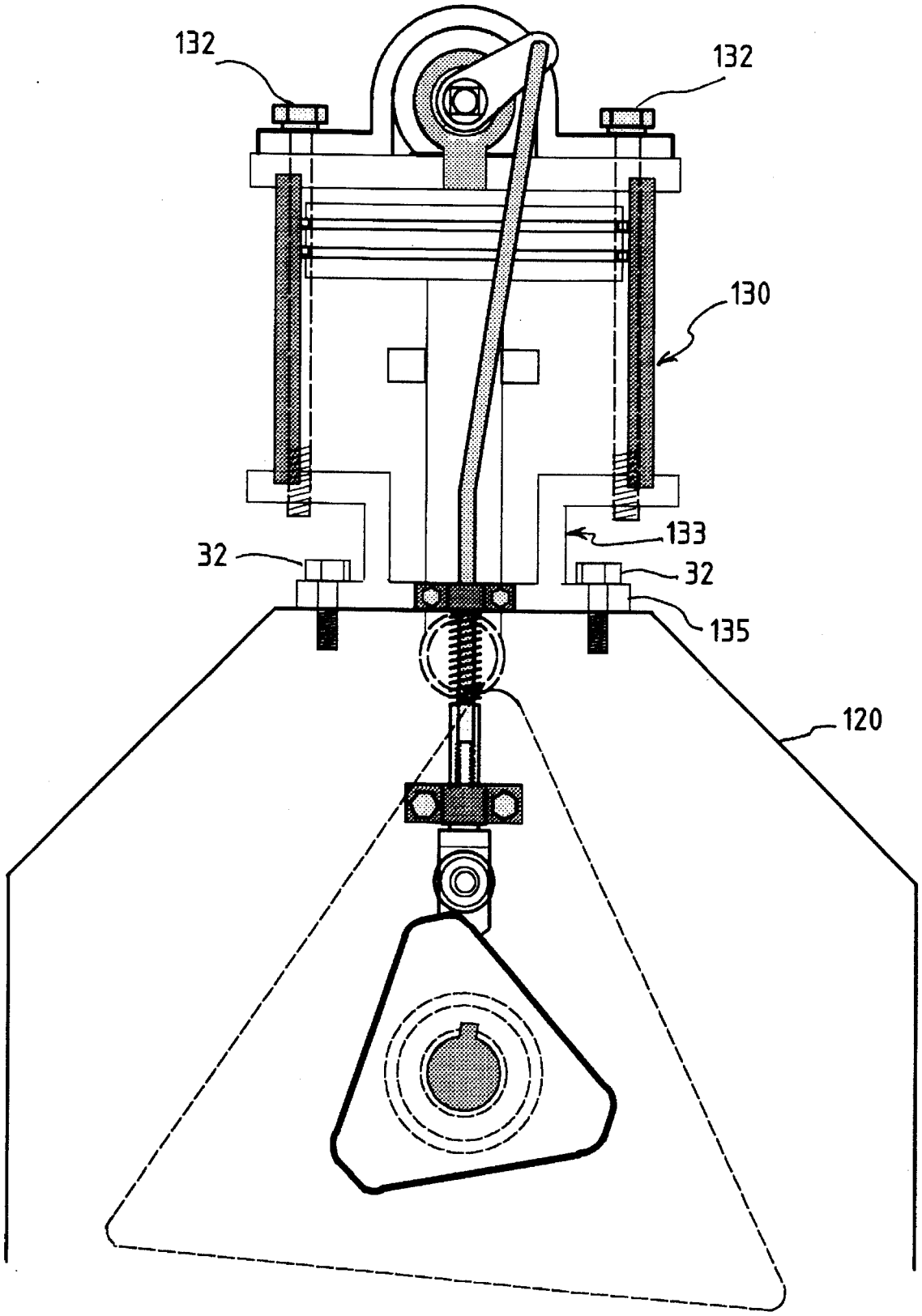
FIGS. 5/6—are similar to FIGS. 3 and 4 respectively, but show a modified cylinder.
Figure 6:
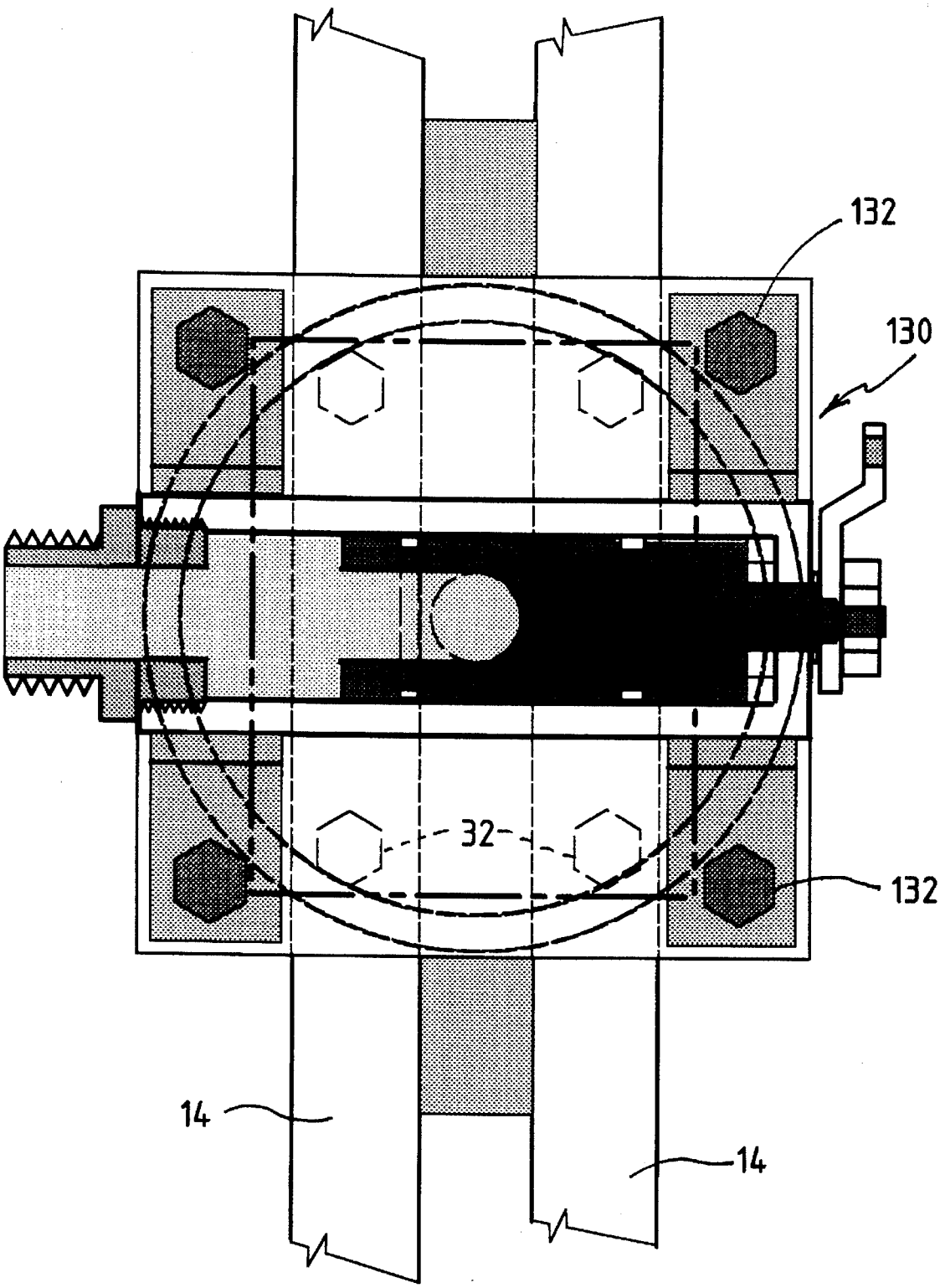

The maintenance of engine 10 is particularly facilitated due to the free floating action of the pistons 40, which permits the cylinders 30 and pistons 40 to be removed simply by the removal of bolts 32, Cylinders 30 may accordingly be replaced by cylinders 130 for example, as seen in FIGS. 5 and 6, which have a substantially greater internal diameter than cylinders 30. In this instance, securement bolts 132 will not intersect the side plates 14 of housing 12. Accordingly, cylinders 130 are supported from mounts 22 by a pedestal 133 having an Internal diameter smaller than that of cylinder 130, whereby bolts 32 passing through an outwardly turned flange 135 serve to secure the cylinder to housing 120 in place of a cylinder 30.

Figure 7:
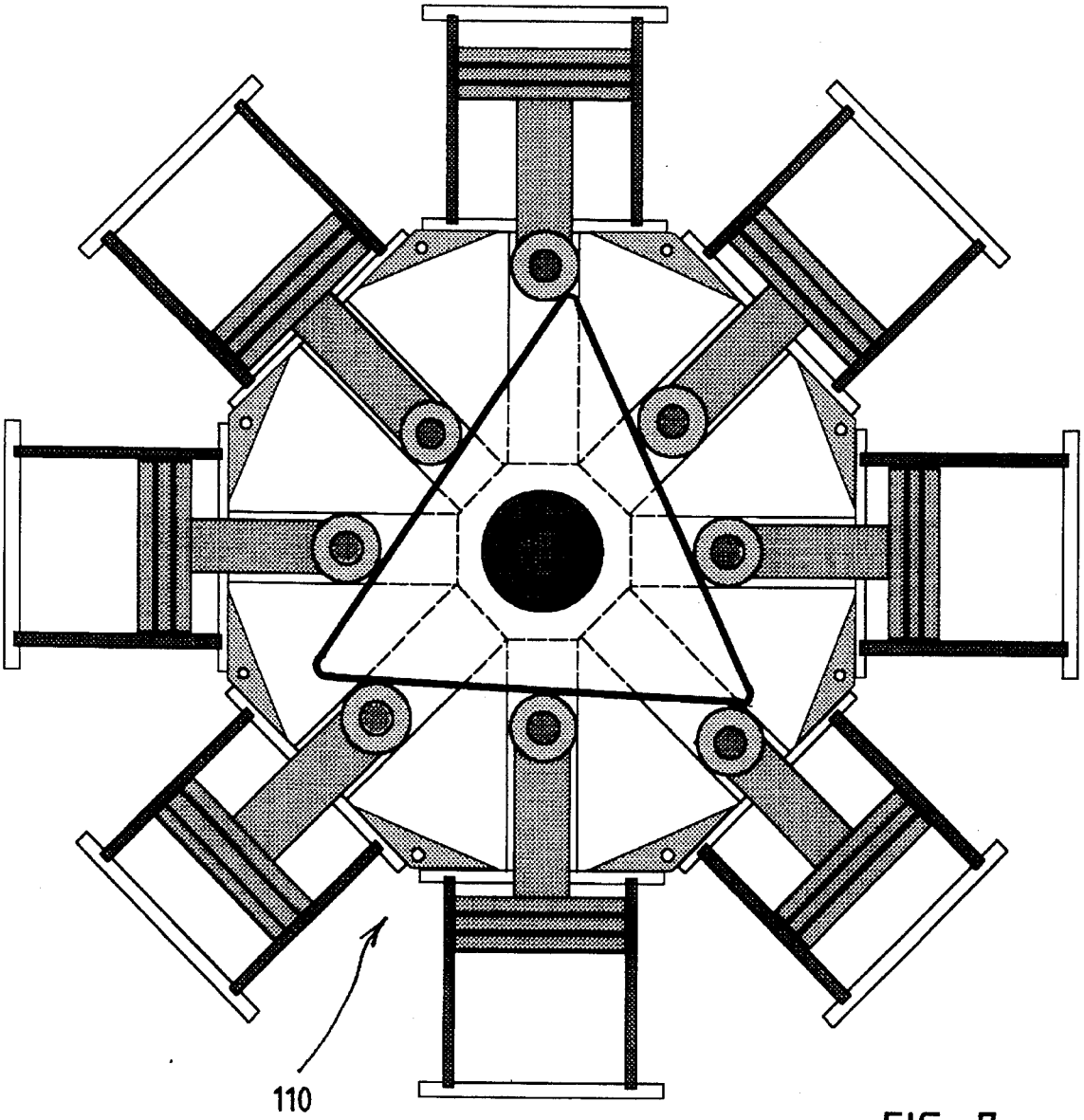
FIG. 7—is similar to FIG. 1 but shows an eight cylinder form of the engine.

The conversion of engine 10 to an eight cylinder engine is equally simple, and involves the removal of caps 34 from the engine of FIG. 1 and the securement of cylinders 30 and related components in their place, to form engine 110 of FIG. 7.

A four cylinder motor 10 will have twelve power strokes per revolution of shaft 16, and this will be doubled for the eight cylinder motor 110. Accordingly, it will be appreciated that this results in motors having an exceptionally high torque and smooth operation.

Although the materials of construction of engine 10 are not critical, much of the structure thereof, including housing 10 is particularly amenable to manufacture from plastic materials, and it is contemplated that the tracks 54 be lined with replaceable liners 56 to facilitate maintenance.

Figure 8:
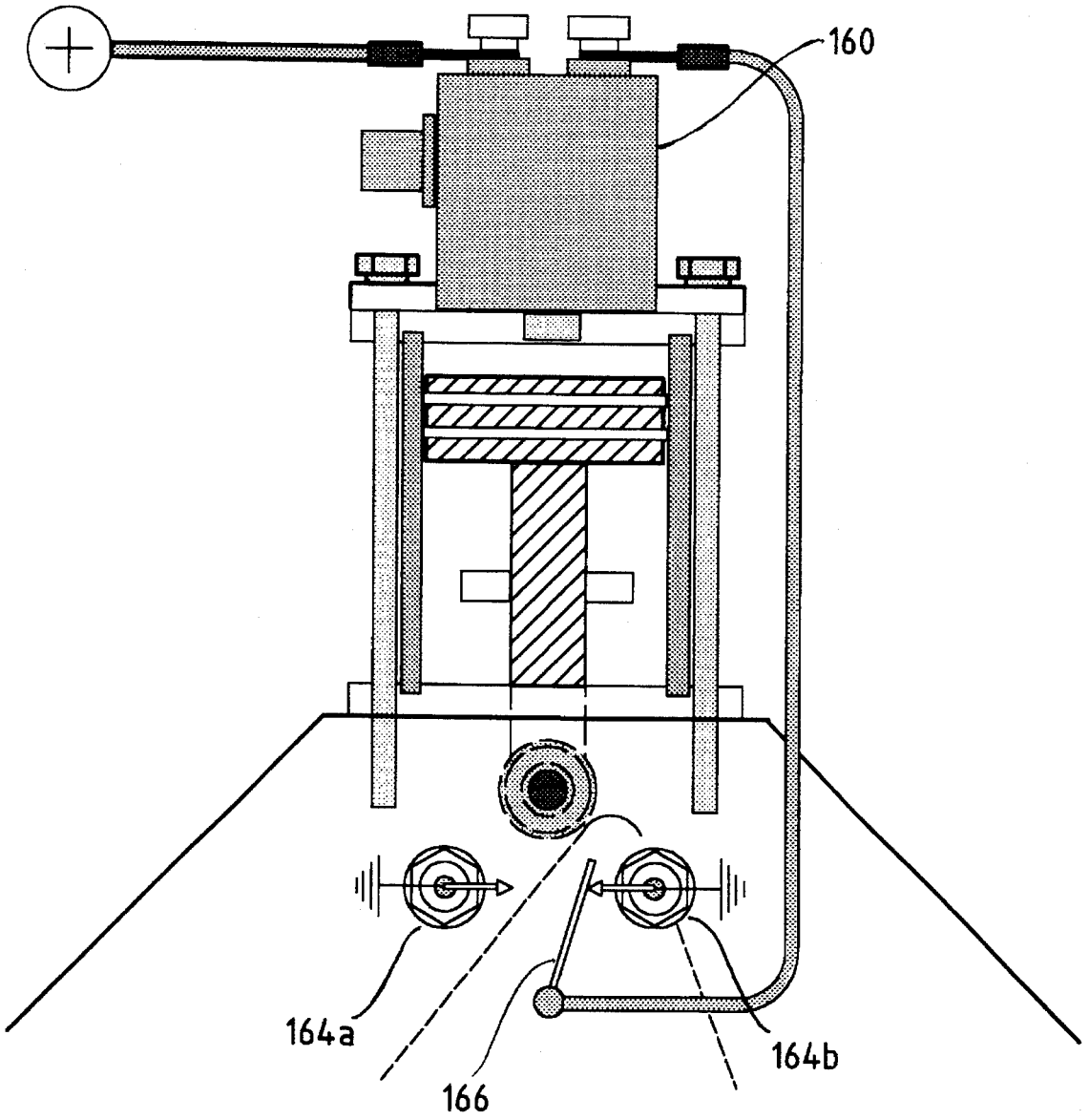
FIG. 8—is a schematic illustration of an electrically operated valve assembly associated with the cylinder.

As seen in FIG. 8, the engine of the invention may have an electrically operated valve assembly 160 associated with each cylinder 130, which takes the place of mechanically operated valve assembly 60 earlier described. Valve assembly 160 includes an associated switch mechanism including switch contacts 164*a*, 164*b* which are actuated by rotor 120, and reversing switch 166 which permits the selection of either of switch contacts 164*a*, 164*b*.

It will be apparent that many changes may be made to the illustrative embodiment while falling within the scope of the invention, and it is intended that all such changes be covered by the claims appended hereto.

We claim:

1. An engine comprising a housing;

shaft means mounted from said housing for rotation relative thereto;

tri-lobed cam means secured to said shaft within said housing;

four primary piston means mounted on said housing in equi-spaced relation about said shaft means;

each said primary piston means comprising a cylinder, a piston mounted for independent reciprocal movement within said cylinder and a cam follower connected to said piston;

the improvement comprising a guide bearing means associated with said cam follower; and track means supported on said housing along which said guide bearing means is moveable as said piston reciprocates in its cylinder;

said guide bearing means serving to transmit to said track means reactive forces generated between said cam and said cam follower which tend to urge said piston into contact with its cylinder.

2. An engine as defined in claim 1 wherein said guide bearing means includes a pair of guide bearings respectively disposed on opposed sides of said cam follower.

3. An engine as defined in claim 2 wherein each said cylinder has a cylindrical axis which intersects the axis of said shaft.

4. An engine as defined in claim 2 wherein each said cam follower and its associated guide bearing means are rotatable and have a collinear axis of rotation.

5. An engine as defined in claim 2 wherein said cam means is essentially in the form of an equilateral triangle having apices rounded with a radius of approximately 6 min.

6. An engine as defined in claim 2 wherein each said piston has a piston rod rigidly secured thereto and said cam follower and said guide bearing means are mounted from said piston rod.

7. An engine as defined in claim 2 wherein said engine has four secondary piston means generally identical to said primary piston means mounted from said housing in symmetrical relationship with said primary piston means.

8. An engine as defined in claim 2 wherein said housing includes a pair of opposed, spaced apart side walls and wherein said track means is formed as slots in said side walls.

9. An engine as defined in claim 8 wherein said slots are provided with replaceable liners.

10. An engine as defined in claim 8 wherein spare slots are provided in said side walls.

11. An engine as defined in claim 1 wherein each said cylinder has an inlet port and wherein valve means is associated with each said inlet port.

12. An engine as defined in claim 11 wherein said valve means is mechanically actuated.

13. An engine as defined in claim 12 wherein said valve means is mechanically actuated by a timing cam and said timing cam is reversibly mounted on said shaft to permit the reverse rotation of said engine.

14. An engine as defined in claim 11 wherein said valve means is electrically actuated.

15. An engine as defined in claim 14 wherein said valve means is electrically actuated by switch means actuated by said cam means.

16. An engine as defined in claim 14 wherein said valve means include a reversing switch.

17. An engine as defined in claim 1 wherein said cylinder includes a pedestal with openings therethrough for attaching said cylinder to said housing, said pedestal having a diameter less than that of the piston of said cylinder.

* * * * *